United States Patent [19]

Lindgren et al.

[11] Patent Number: 4,989,392

[45] Date of Patent: Feb. 5, 1991

[54] WASHING AND CLEANING SYSTEM ON A PACKING MACHINE

[75] Inventors: Christer Lindgren, Ystad; Rolf Schildt, Landskrona, both of Sweden

[73] Assignee: Tetra Pak Holdings & Finance S.A., Pully, Switzerland

[21] Appl. No.: 446,687

[22] Filed: Dec. 6, 1989

[30] Foreign Application Priority Data

Dec. 21, 1988 [SE] Sweden ..... 8804603

[51] Int. Cl.[5] ..... B65B 55/24; B65B 55/10

[52] U.S. Cl. ..... 53/167; 53/426; 134/144

[58] Field of Search ..... 53/167, 426, 425, 431, 53/141, 111 RC, 111 R; 134/144, 167 R

[56] References Cited

U.S. PATENT DOCUMENTS 2,918,071 12/1959 Umbricht et al. ..... 134/144

3,783,581 1/1974 Pierce ..... 53/426

3,847,753 11/1974 Baird et al. ..... 134/144 X 4,375,145 3/1983 Mosse et al. ..... 53/425

4,798,334 1/1989 Harrington ..... 134/167 R X

*Primary Examiner*—James F. Coan

*Attorney, Agent, or Firm*—Burns, Doane, Swecker & Mathis

[57] ABSTRACT

A washing and cleaning system in a packing machine which manufactures filled packing containers from tubular container cases, wherein the packing machine includes a housing, a plurality of stations located in the housing, and a conveyor for conveying the cases from station to station. The washing and cleaning system includes a guide bar, a slider slidably mounted on the guide bar, a plurality of nozzles mounted on the slider and at least one vessel containing cleaning and washing fluid for supplying cleaning and washing fluid to the nozzles.

16 Claims, 2 Drawing Sheets

WASHING AND CLEANING SYSTEM ON A PACKING MACHINE

FIELD OF THE INVENTION

The present invention relates to a washing and cleaning system. More particularly, the present invention relates to a washing and cleaning system for a packing machine of the type which produces filled packing containers from prefabricated tubular container cases and which within a substantially wholly closed machine housing comprises a bottom-forming station, a filling station, a top-forming station and a driven chain or band conveyor for transporting the cases in turn and succession between the various stations.

BACKGROUND OF THE INVENTION

Liquid foodstuffs of the milk, juice etc. types are packed and conveyed at present in most cases in finished consumer packages of a non-returnable character which are made from a laminated packing material that customarily consists of thermo-plastic-coated paper. A very large group of these so-called non-returnable packages is manufactured either from prefabricated blanks, from tubular, flattened container cases or from a web of packing material with the help of modern high-capacity packing machines of the type which form, fill and close in a liquid-tight manner the finished packages. A packing machine of the type which manufactures packages from prefabricated tubular container cases is described extensively in, for example, Swedish patent No. 361,857. In order to simplify the present description with respect of the details of the packing machine known already, reference is made to the Swedish patent for closer details concerning the design of the machine. To facilitate an understanding of the present invention however, a summary outline of the manner in which the machine manufactures the packages is provided hereinafter. The flattened container cases, whilst being raised to open tubular shapes, are fed from a magazine positioned close to the machine onto a movable conveyor band which transports the cases into a bottom-forming station at the input end of the machine.

The bottom-forming station comprises one or more intermittently rotatable wheels with radial mandrels whereon the cases supplied are threaded up and transported through a number of forming and sealing stations located round the wheel in order to provide the cases with a liquid-tight bottom closure. From the mandrel-wheel the cases provided with bottoms are placed onto a synchronously driven chain or band conveyor on which the cases in turn and sucession are conveyed to a filling station where the cases are filled with the intended contents. The cases are then conveyed to a top-forming station where the filled cases are provided with a liquid-tight top closure by means of an appropriate forming and sealing operation. After the passage through the top-forming station the finished packages are discharged towards the discharge end of the machine for further distribution.

For optimum utilization of the production capacity of the machine it is customary to operate machines of this type continuously every day of the week from early in the morning until late in the evening with stoppages only at night-time and during planned, regularly recurring periods for more extensive maintenance and service work. Machine stoppages naturally also occur when during normal working hours the machine is to be changed from the filling of one product to another.

The demands on hygiene and cleanliness when handling foodstuffs naturally have to be set very high so that it is possible for the foodstuffs to be stored without any risk of being destroyed or impaired during at least a certain guaranteed keeping period, and also so as to avoid or, minimize for as long as possible, the risk of the foodstuff coming into contact with, or being contaminated by, harmful bacteria and similar microorganisms which could grow rapidly in the foodstuff and and thus become a serious source of the spreading of infections. To meet these demands on cleanliness it is necessary, therefore, that the packing machine be subjected regularly to a cleaning and washing treatment which not only concerns the machine components which during the manufacture of the package come into contact with the contents but also the machine components which run the risk of coming into contact with the contents or which are located in the close surroundings of the production line. Such a thorough cleaning and washing treatment of the machine was carried out up to now more or less manually and was not only time-consuming but was also associated with difficulties with respect to being able to reach and to clean the nooks and corners in the machine which are present in large numbers in such complicated machine designs. In order to avoid unnecessarily disturbing the production of packages, the cleaning work in general was arranged, therefore, to be carried out in periods when the machine is normally out of operation, for example in connection with a machine shutdown for night stoppage. Cleaning work naturally is carried out also in connection with a maching being changed from one product to another.

OBJECTS AND SUMMARY OF THE PRESENT INVENTION

It is an object of the present invention to provide a washing and cleaning system by means of which the packing machine with the least possible contribution of manual labour, can be washed and cleaned effectively during only a fraction of the time which has been necessary up to now for a corresponding manual washing and cleaing operation.

This object is achieved in accordance with the present invention through a washing and cleaning system which comprises a number of freely adjustable nozzles arranged around the slide which are connected to one or more vessels containing fluids required for the washing and cleaning and which are distributed and aligned so that at least the main part of all the machine components and spaces present within the machine housing as well as the inside of the surrounding machine housing are accessible to the fluid issuing through the nozzles during a reciprocating movement of the slide.

With the help of the movable slide provided with nozzles, which thus substantially wholly replaces the previous manual washing and cleaning treatment, a corresponding treatment can be carried out with only a minimal amount of manual intervention being required, e.g. when the treatment is set into operation and stopped, which is not only a labour-saving advantage but which also means that the treatment can be carried out in an appreciably shorter time than has been possible previously.

In order to supplement the treatment carried out with the help of the slide equipped with nozzles, for example on particularly inaccessible or hidden spaces and machine components or on machine components which are specially exposed to the splashing of contents or which come into contact with the inside of the container cases which are to be filled, the washing and cleaning system may also comprise a number of further supplementary nozzles, firmly mounted on such spaces or machine components, which likewise are connected to the vessels containing washing and cleaning fluids and are aligned so that they make possible a concentration of this fluid to the aforementioned regions of the machine.

In accordance with a further embodiment the system can be connected to an electric control circuit comprising a preprogrammed microprocessor with the help of which the system can perform its intended washing and cleaning treatment in accordance with a predetermined working schedule.

BRIEF DESCRIPTION OF THE DRAWINGS

The present invention will be described in greater detail with special reference to the attached drawings, wherein.

DETAILED DESCRIPTION OF THE PREFFERRED EMBODIMENT

Figure 1:
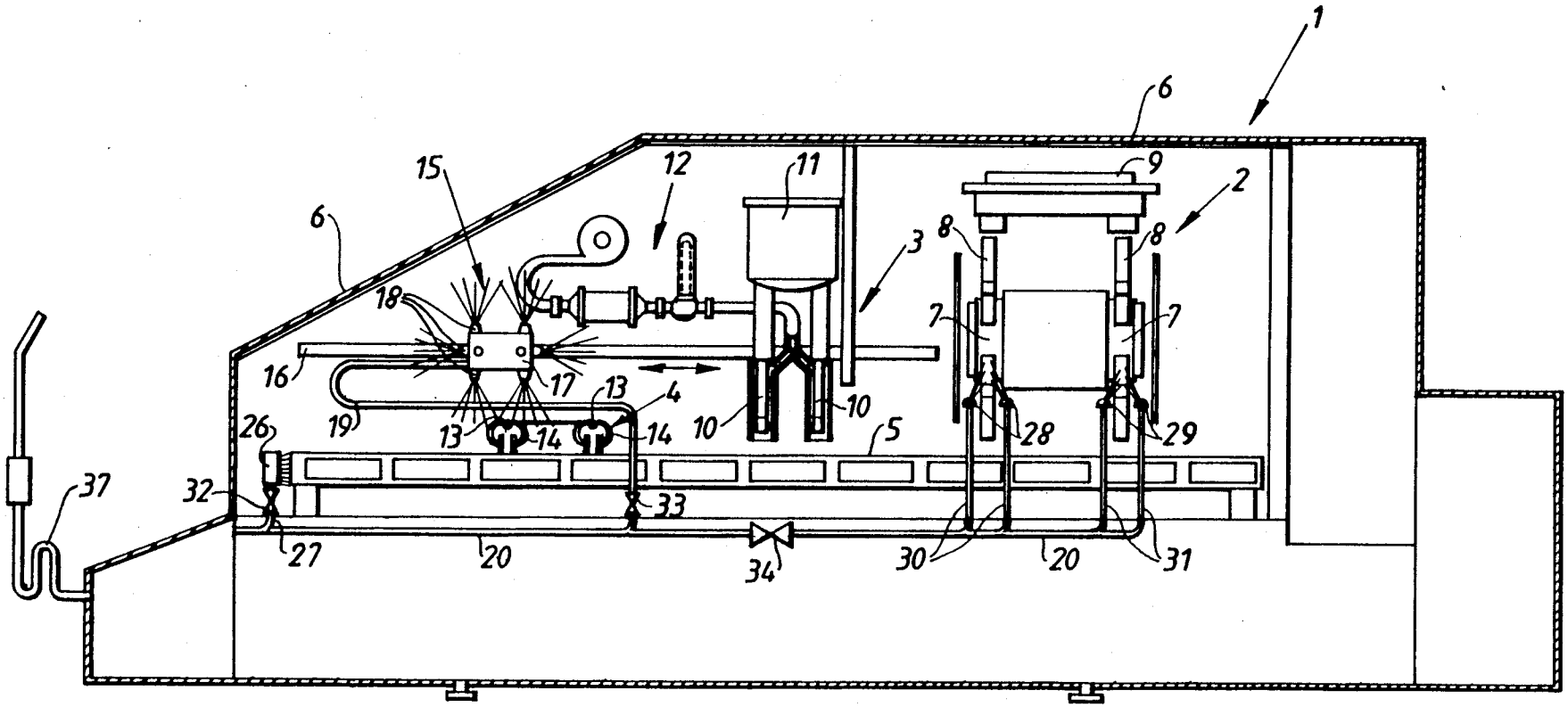
FIG. 1 is a side view of the interior of a packing machine, provided with a washing and cleaning system in accordance with the invention.

FIG. 1 shows a packing machine of the type which has been described above and which from prefabricated, tubular, flattened container cases manufactures finished, filled packing containers for liquid foodstuffs, e.g. milk. The machine which has been given the general reference designation 1 comprises in turn and succession from the input end of the machine i.e., the right end in FIG. 1) a bottom-forming station 2, a filling station 3 and a top-forming station 4 and a driven chain or band conveyor 5 for transporting cases through the stations and further, out through the discharge end of the machine i.e., and left end in FIG. 1) for further handling and distribution. To avoid or reduce the effect of possible pollutants in the surrounding atmosphere of the machine, and at the same time to limit splashing of contents and the like during the operation of the machine, all the stations are covered by a common, essentially wholly closed, maching housing 6 which also contributes to a dampening of the noise level of the machine.

The bottom-forming station 2 in the present example of the machine comprises two synchronously operating, intermittently rotatable mandrel wheels 7, each of which carries a number of radial mandrels 8 for transporting the tubular cases through a number of forming and sealing stations 6 located round the wheel.

The filling station 3 comprises two filling pipes 10 which are connected to a common contents tank 11 from which the cases, provided with bottoms, moved forwardly on the conveyor 5, are filled with a specified portion of contents with the help of a suitable metering arrangement, not shown, which controls the portioning out of contents through the downwardly directed filling pipes 10. It is also evident from the FIG. 1 that the filling station 3 can be connected to a conditioning system 12 of a known type to create an atmosphere of chilled, sterile air suitable for the filling station in the immediate vicinity of the filling pipe 10 and thereby minimize the risk of undersirable formation of condensation on the outsides of the filling pipes.

The top-forming station 4 comprises two pressing-down and sealing devices 13, each of the which comprising sealing jaws 14 movable towards one another, between which foldable, open top parts of the filled cases are sealed together with one another for the liquid-tight closing of the cases.

With the help of the machine 1 described above, filled packing containers are manufactured from prefabricated container cases. From a magazine positioned close to the input end of the machine the causes are fed one by one while being simultaneously raised up to the open tubular shape onto a movable conveyor band which transports the raised container cases and threads them into radial mandrels 8 of the wheel 7 at the bottom-forming station 2 of the machine. In the course of the intermittent rotation of the wheel 7 the thread-on cases are led through a number of forming and sealing stations 9 located round the wheel for the closing of one end, (i.e., the bottom forming end) of the cases. The cases provided with bottoms are drawn off the mandrels 8 and placed onto a driven chain or band conveyor 5 which in rhythm with the intermittent rotation of the wheel 7 advances the case to the filling station 3 of the machine directly below the downwardly directed filling pipes 10 for the portioned filling with the intended contents. From the filling station 3 the filled cases are advanced further on the conveyor 5 into the top-forming station 4 of the machine where the upper open end of the cases is closed in liquid-tight manner with the help of the synchronously operating pressing-down and sealing device 13. From the top-forming station 4 the finished packages are discharged from the machine for further handling and distribution.

Figure 2:
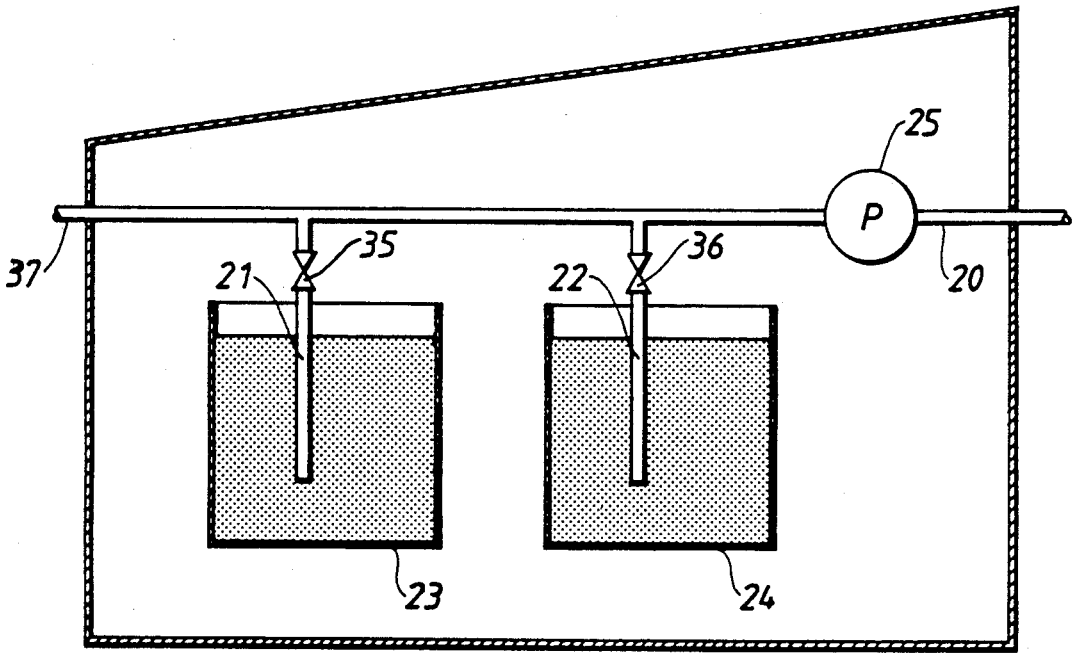
FIG. 2 is a side view of a part of the system in greater detail.

A mentioned earlier, the machine has to be subjected regularly to an extensive cleaning and washing, for example in connection with a natural machine stoppage for the night or in connection with the machine being changed over from the filling of one product to another. For this purpose the machine 1 is provided with an automatic washing and cleaning system with the general reference designation 15. The system 15 comprises a guide bar 16 arranged straight above and parallel with the conveyor 5 which carries a slide 17 that is movable to and fro along the guide bar and that is driven with the help of a cylinder without piston rod or a linear motor of a known type. The slide 17 has a number of nozzles 18 distributed around the slide in connection with a flexible tube 19 which through a main duct 20 and branch pipes 21 and 22 (FIG. 2) connected to the main duct is in connection with vessels 23 and 24 respectively containing fluids required for the washing and cleaning. The nozzles 18, moreover, are distributed and aligned so that the fluid, with the help of a pump 25 (FIG. 2) provided in the main duct 20 is made to issue through them from the respective vessel, reaches and covers substantially all machine components situated within the machine housing 6, including the inside of this housing, when the slide 17 is moved along the guide bar 16.

To make possible a particularly thorough or supplementary washing and cleaning of specially exposed machine components or regions of the machine which are not readily accessible to the nozzles 18, the system 15 comprises, moreover, a number of further supplementary nozzles which are firmly mounted at such machine components or regions. In the embodiment shown the system thus has such as supplementary nozzle 26 especially aligned towards the conveyor 5 at the discharge end of the machine, which is in connection with the main duct 20 through a duct 27, and other such supplementary nozzles 28 and 29 are present on, and especially directed towards, the mandrels 8 on the respective mandrel wheel 7, which likewise are connected to the main duct 20 through ducts 30 and 31 respectively.

To make possible an optional actuation of the nozzles, the respective nozzle ducts are provided with, or are individually controlled by, control valves 32–34 which together with a valve 35 in the pipe 21 and valve 36 in the pipe 22 may be connected to, and controlled by, an electric control circuit, not shown. The electric control control circuit can include a preprogrammable microprocessor with whose help the connection of the nozzles with the vessels 23 and 24 as well as with an outer water duct 37 connected to the main duct 20 can be opened and interrupted according to a preprogrammed working schedule.

To clean the machine 1 with the help of the washing and cleaning system 15 described, the procedure is as follows: The valves 33 and 34 are closed while the valve 32 is opened and the conveyor 5 is put into operation. The pump 25 is started at the same time as one of the valves 35 and 36 is opened, as a result of which washing and cleaning fluid is squirted under pressure (approx. 70 bar) through the nozzle 26 towards the conveyor 5 passing by. After approx. 1 minute the conveyor 5 is stopped and the valve 32 is closed. The valve 33 is opened and the slide 17 is actuated to perform a reciprocating movement along the guide bar 16. During this movement the washing and cleaning fluid issuing through the nozzles 18 will sweep over and cover essentially all machine components present within the machine housing 6, including the inside of this housing, and after approx. 1 minute the connection between the nozzles 18 and the source of washing and cleaning fluid is broken owing to the open valves 35 or 36 being closed and the slide 17 being stopped. The fluid squirted out is allowed to work for approx. 10 minutes, whereafter the slide 17 is actuated again to perform a reciprocating movement along the guide bar 16. During this movement the connection between the nozzles 15 and the outer water duct 37 is opened, as a result of which a thorough flushing out of the cleaning fluid squirted out earlier is provided. After approx. 10 minutes of flushing, the connection to the water duct 36 is interrupted and the slide 17 is stopped. The valve 34 and one of the valves 35 and 36 are opened at the same time as the wheel 7 is actuated and the mandrels 8 are rinsed with washing and cleaning fluid during the passage past the nozzles 28 and 29. After a final flushing with water the wheel 7 is stopped and the pump 25 is halted, whereupon the machine is washed and cleaned and ready for a new manufacture and filling of packing containers.

As mentioned already, the regulation of the valves as well as the actuation of the conveyor 5 and the mandrel 7 may take place wholly automatically with the help of a microprocessor which appreciably reduces the number of manual interventions necessary and which, therefore, in practice can be limited so as to comprise merely the actual setting into operating of the washing and cleaning procedure. The automatic process also entails the further advantage that the consumption of chemicals as well as of water can be kept very low without the demand on a high, optimum cleaning effectiveness being neglected.

While this invention has been illustrated and described in accordance with a preferred embodiment, it is recognized that variations and changes may be made and equivalents employed without departing from the spirit and scope of the present invention as set forth in the claims.

What is claimed is:

1. A packing machine for manufacturing filled packing containers from prefabricated tubular container cases, comprising:

a substantially completely closed housing;

a bottom forming station located in the housing for closing and sealing a bottom end of the cases;

a filling station located in the housing for filling the cases;

a top-forming station located in the housing for closing and sealing a top end of the cases;

a conveyor located in the housing and extending between the bottom forming station, the filling station and the top forming station for conveying the cases from station to station;

a guide bar located in the housing;

a slider movably mounted on the guide bar for movement between the bottom forming station, the filling station and the top forming station;

a plurality of spaced apart nozzles mounted on the slider;

at least one vessel containing cleaning and washing fluid for cleaning and washing the inner surface of the housing and components located in the housing;

means fluidly connecting the nozzles to the at least one vessel for supplying cleaning and washing fluid from the at least one vessel to the nozzles.

2. The packing machine according to claim 7, including at least one first supplementary nozzle fixedly mounted and directed towards said conveyor for spraying cleaning and washing fluid on the conveyor, a plurality of second supplementary nozzles fixedly mounted and directed toward said bottom forming station for spraying cleaning and washing fluid on components defining said bottom forming station, and means fluidly connecting said first and second supplementary nozzles to said at least one vessel for supplying cleaning and washing fluid from the at least one vessel to the first and second supplementary nozzles.

3. A method of cleaning and washing a packing machine that manufactures containers from container cases and that includes a housing, a plurality of stations located in the housing and a conveyor for conveying the cases from station to station, the method comprising the steps of:

moving a slider having a plurality of nozzles mounted thereon along a guide bar;

supplying cleaning and washing fluid to the nozzle;

spraying the inside of the housing and components located in the housing with cleaning and washing fluid from the nozzle.

4. The method according to claim 3, including stopping the movement of the slider or the guide bar, stopping the supply of cleaning and washing fluid to the nozzle, waiting a predetermined time to allow the cleaning and washing fluid to work, moving the slider along the guide bar at the end of the predetermined time period, supplying water to the nozzle, and spraying the inside of the housing and the components in the housing with the water from the nozzles.

5. The method according to claim 4, wherein said plurality of stations includes a bottom forming station, the method including the steps of stopping the movement of the slider on the guide bar, stopping the supply of water to the nozzles, supplying cleaning and washing fluid to a plurality of fixedly mounted supplementary nozzles directed towards the bottom forming station, and spraying components of the bottom forming station with the cleaning and washing fluid through the supplementary nozzles.

6. The method according to claim 3, including, prior to moving the slider and spraying the inside of the housing and the components, the steps of operating the conveyor so that the conveyor moves, supplying cleaning and washing fluid to a supplementary nozzle directed at the moving conveyor, and spraying the moving conveyor with washing and cleaning fluid through the supplementary nozzle.

7. A washing and cleaning system for a packing machine which fills packing containers formed from container cases, said packing machine including a substantially closed housing, a plurality of stations located in the housing and a conveyor for conveying the container cases from station to station in the housing, said washing and cleaning system comprising:

a guide bar located in the housing;

a slide mounted on the guide bar and movable back and forth along the length of the guide bar;

a plurality of nozzles mounted on said slide, means for supplying cleaning and washing fluid to said nozzles so that as the slide moves along the guide bar, said nozzles being arranged to spray fluid on the inner surface of the housing and components defining the plurality of stations.

8. The washing and cleaning system according to claim 7, wherein said nozzles are adjustably mounted on the slide.

9. The washing and cleaning system according to claim 7, including at least one first supplementary nozzle mounted adjacent said conveyor for spraying washing and cleaning fluid on the conveyor.

10. The washing and cleaning system according to claim 9, including at least one second supplementary nozzle mounted adjacent one of said stations for spraying washing and cleaning fluid on the one station.

11. The washing and cleaning system according to claim 7, wherein said nozzles mounted on said slide are fluidly connected to a flexible tube, said flexible tube being fluidly connected to a main duct and said main duct being fluidly connected to said at least one vessel, said flexible tube including valve means for controlling the flow of washing and cleaning fluid to the nozzles mounted on the slide.

12. The washing and cleaning system according to claim 10, wherein said first and second supplementary nozzles are fluidly connected to branch ducts, said branch ducts being fluidly connected to a main duct and said main duct being fluidly connected to the at least one vessel, the branch duct fluidly connecting the main duct to the first supplementary nozzle including valve means for controlling the flow of cleaning and washing fluid to the first supplementary nozzle, anad the main duct including valve means for controlling the flow of washing and cleaing fluid to the second supplementary nozzles.

13. The washing and cleaning system according to claim 7, wherein there are two vessels containing cleaning and washing fluid, each vessel being fluidly connected to a main duct by branch pipes, the nozzles on the slide and the first and second supplementary nozzles being fluidly connected to the main duct, each of said branch pipes including valve means for controlling the flow of cleaning and washing fluid from the vessels to the main duct.

14. The washing and cleaning system according to claim 4, wherein said guide bar is positioned above the conveyor and is substantially parallel to the conveyor.

15. The washing and cleaning system according to claim 7, including means for driving the slider.

16. The washing and cleaning system according to claim 7, including a microprocessor for controlling the operation of the cleaning and washing system.

* * * * *